United States Patent [19]

Gloger

[11] Patent Number: 5,070,556

[45] Date of Patent: Dec. 10, 1991

[54] KNOCKDOWN STORAGE BED WITH ROLLER SUPPORTED DRAWERS

[76] Inventor: Kelly C. Gloger, P.O. Box 221, Meriden, N.H. 03770

[21] Appl. No.: 564,942

[22] Filed: Aug. 9, 1990

[51] Int. Cl.[5] ..... A47C 19/00

[52] U.S. Cl. ..... 5/308; 5/201; 5/400; 16/35 R; 312/342; 312/348.2

[58] Field of Search ..... 5/200.1, 201, 297, 308, 5/400; 16/18 R, 18 A, 18 B, 29, 30, 35 R; 312/342, 345, 348.2

[56] References Cited

U.S. PATENT DOCUMENTS

| | | | |
|---|---|---|---|
| 339,614 | 4/1886 | Beale | 312/342 |
| 1,289,897 | 12/1918 | Phillips | 5/308 |
| 1,896,346 | 2/1933 | Bolhuis | 5/308 X |
| 2,997,355 | 8/1961 | Preble | 312/342 |
| 4,229,855 | 10/1980 | Rowe | 16/29 |
| 4,597,122 | 7/1986 | Handler et al. | 5/308 X |
| 4,617,689 | 10/1986 | Nelson et al. | 5/400 |
| 4,874,209 | 10/1989 | Spitzer et al. | 16/30 X |

*Primary Examiner*—Rodney M. Lindsey
*Assistant Examiner*—Michael Milano
*Attorney, Agent, or Firm*—Sughrue, Mion, Zinn, Macpeak & Seas

[57] ABSTRACT

A knockdown bed formed of a plurality of longitudinally spaced, parallel, transversely extending, U-shaped channel members detachably coupled by latch assemblies within respective ends of the U-shaped channel members engaging receiver assemblies fitted at longitudinally spaced positions on facing surfaces of opposed side boards of the bed, with the channel members having open slots on each side thereof, and receiving thin, rectangular panels to form a planar box spring and mattress support across the top of the bed, act to partially suspend drawers which are positioned beneath the planar box spring and mattress support.

14 Claims, 9 Drawing Sheets

FIG. 12
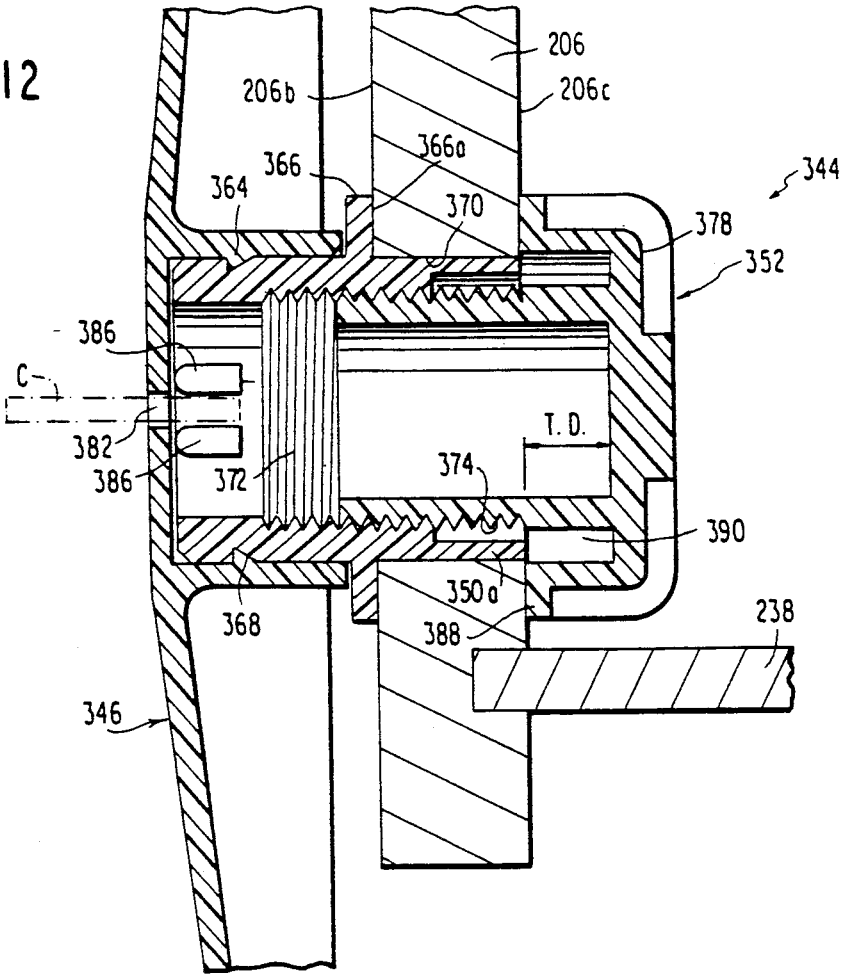
FIG. 13
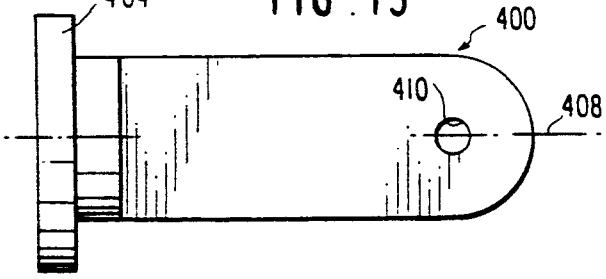
FIG. 15
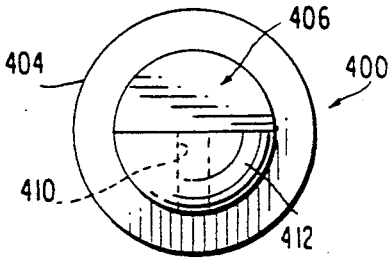
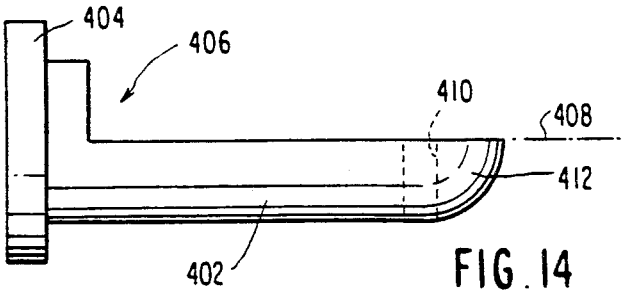
FIG. 14

KNOCKDOWN STORAGE BED WITH ROLLER SUPPORTED DRAWERS

Field Of The Invention

This invention relates to a knockdown type bed having detachable couplings at opposed ends of channel members to receivers affixed to side boards or side rails which channels slidably receive insertable panels to form with the channel members a planar mattress support system, and more particularly to a roller support system for drawers slidably insertable beneath the planar mattress support system and suspended between longitudinally spaced, transversely extending channel members.

BACKGROUND OF THE INVENTION

The applicant within recent years has developed knockdown, rectangular storage or platform beds which may support slidable drawers within one side or both sides of the bed via a unique framing structure, which drawers slide into openings within the bed frame and underparts supporting the box spring and mattress to permit the storage of clothing and the like within said drawers. Such beds are the subject of U.S. Pat. No. 4,671,689 issued Oct. 21, 1986 entitled. "BED FRAME AND RELEASABLE COUPLING EMPLOYED THEREIN".

Such knockdown bed is comprised of opposed, longitudinally separated end boards, laterally opposed side boards and a plurality of U-shaped channel members of a length approximating the length of the end boards for connection of the opposed end boards and side boards in a rigid, rectangular frame assembly. Each of the U-shaped channel members mounts an overcenter latch assembly at opposite ends of each channel member for detachably coupling the channel member ends to receiver assemblies fixedly mounted to and at longitudinally spaced positions along the bed opposed side boards.

The channel members include laterally projecting flanges on each side thereof defining C-shaped slots to each side thereof. Thin, rectangular, hollow core panels are slidably inserted within the facing C-shaped slots of adjacent channel members to form a planar box spring and mattress support across the top of the bed and extending longitudinally from one end board to the other and laterally from one side board to the other. The U-shaped channel members which support the thin panels are inverted with their open ends facing downwardly and with the channel member bottoms nearly flush with the panels.

In one embodiment of the knockdown beds of the '689 Patent, the side boards take the form of an open ladder frame of rectangular configuration including vertical risers joining top and bottom board members and defining a series of longitudinally spaced, rectangular openings therein. A lower row of U-shaped channel members are detachably mounted by latch assemblies to receiver assemblies fixedly mounted to the inside of the side boards at spaced longitudinal positions along the bottom board of the open ladder frame. The channel members of both rows form four corner slides for a plurality of rectangular, upwardly open drawers inserted through the openings of the ladder frame, with the corners engaging the slides and thereby permitting the drawers to function as openable and closable storage containers for the knockdown bed. In the knockdown platform and storage beds of the '689 Patent, the U-shaped channel members include respective ones affixed directly to the headboard and footboards, along the sides of the channel members such that the detachable coupling between the U-shaped channel members via the overcenter latch assemblies and the receiver assemblies fixedly mounted to the bed sideboard connect the headboard and footboard to respective ends of the laterally opposed side boards.

Further, each coupling receiver assembly includes a U-shaped channel guide member sized and configured to fit into the interior of the channel member at its open end and being fixedly mounted to the face of the sideboard. A vertical plate-like catch is mounted to the interior of the U-shaped guide member and terminates at its upper end in a C-shaped hook portion whose open side faces away from the channel member. The overcenter coupling or connection is effected by a latch assembly which comprises an inverted U-shaped saddle member, including horizontal base, legs depending from the base at opposite sides thereof with the legs terminating in bosses which project outwardly of the legs to opposite sides of the saddle member. The bosses are received within holes of the U-shaped channel members for pivoting of the saddle member about an axis defined by the bosses. An integral finger projects upwardly from and at right angles to the base of the saddle member. A U-shaped wire latch bar is pivoted at free ends thereof to the base and projects outwardly from the base. The latch bar is pivotable between positions in line with the base and at generally right angles thereto and parallel to the finger. The U-shaped wire latch bar is of a length and the holes for rotatably mounting the bosses are positioned remote from the end of the channel member, such that the U-shaped wire latch bar may be positioned with its center engaging the C-shaped hook portion of the plate-like catch with the finger at right angles to the U-shaped wire latch bar and parallel to the side board bearing the receiver assembly. With the finger deflected from raised vertical position to a generally horizontal position, the U-shaped wire latch bar pivots overcenter, i.e., across the pivot axis defined by the bosses, causing the end of the channel bar to abut the side board and capture the channel guide internally of the U-shaped channel member and being rigidly coupled thereto via the overcenter action of the coupling latch bar.

While the knockdown platform and knockdown storage beds of the '689 Patent permit the ready set up and disassembly of each type of bed, and which may adequately support slidable drawers, such beds require upper and lower rows of receiver assemblies fixed to the side boards of the bed, and upper and lower sets of channel members longitudinally spaced and extending parallel to each other and being fixed along the top and bottoms of the side boards to function as guides for the slidable drawers. Further, the bed frame itself must absorb the load of the goods stored within the drawers. Additionally, the fixed mounting of the channel members to the sides of the headboard and footboard, while suitable for certain specific platform and storage bed, limit the channel member insertable panel assembly as a planar mattress support to those platform and storage bed styles, and to date have not been adaptable to traditional 4-leg platform type bed.

It is therefore a primary object of the present invention to provide such platform, storage beds which utilize a series of U-shaped channel members mounting the overcenter latch assemblies and detachably coupling channel members ends to receiver assemblies fixedly mounted to opposed side rails of more traditional, 4-legged platform beds, which support thin panels slidably inserted within facing C-shaped slots of adjacent channel members to form a planar box spring and mattress support across the top of the bed without interfering with the use of conventional hardware for attaching the mattress rails to the head and footboard, which provides a simple support system utilizing the channel members for supporting and guiding the drawers slidably inserted into the interior of the bed beneath the bed members providing a planar mattress support with reduced friction, and which permits a significant portion of the mass carried by the drawers to be supported by the underlying floor rather than the bed frame itself, and wherein the overcenter latch assembly functions additionally as guides for guiding the drawers during insertion and removal from their position beneath the planar mattress support assembly.

BRIEF DESCRIPTION OF THE DRAWINGS

FIG. 12 is a sectional view through the drawer front wheel assembly of FIG. 9.

FIG. 13 is a top plan view of a plug drawer block for locking the drawer components together for a knockdown bed in accordance with the embodiment of FIG. 1.

FIG. 14 is a side elevational view of the plug drawer block of FIG. 13.

FIG. 15 is an end view of the plug drawer block of FIGS. 13 and 14.

DESCRIPTION OF THE PREFERRED EMBODIMENTS

Referring initially to FIGS. 1–5, inclusive, there is depicted a knockdown, storage bed forming a preferred embodiment of the present invention. That bed has similarity to the bed of FIG. 2 of applicants U.S. Pat. No. 4,617,689 and employs some components which are identical, some which are similar, and some which are new. The content of U.S. Pat. No. 4,617,689 is specifically included by reference herein. Further, the elements within applicants embodiment of FIGS. 1–5, inclusive, in this application employ numerical designations common to elements within the FIGS. 1–9, inclusive, of U.S. Pat. No. 4,617,689.

Figure 4:
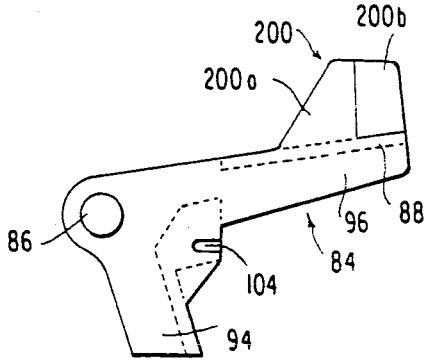
FIG. 4 is a side elevational view of a latch with an integral guide wing employed in the knockdown bed of FIGS. 1 and 2.
Figure 5:
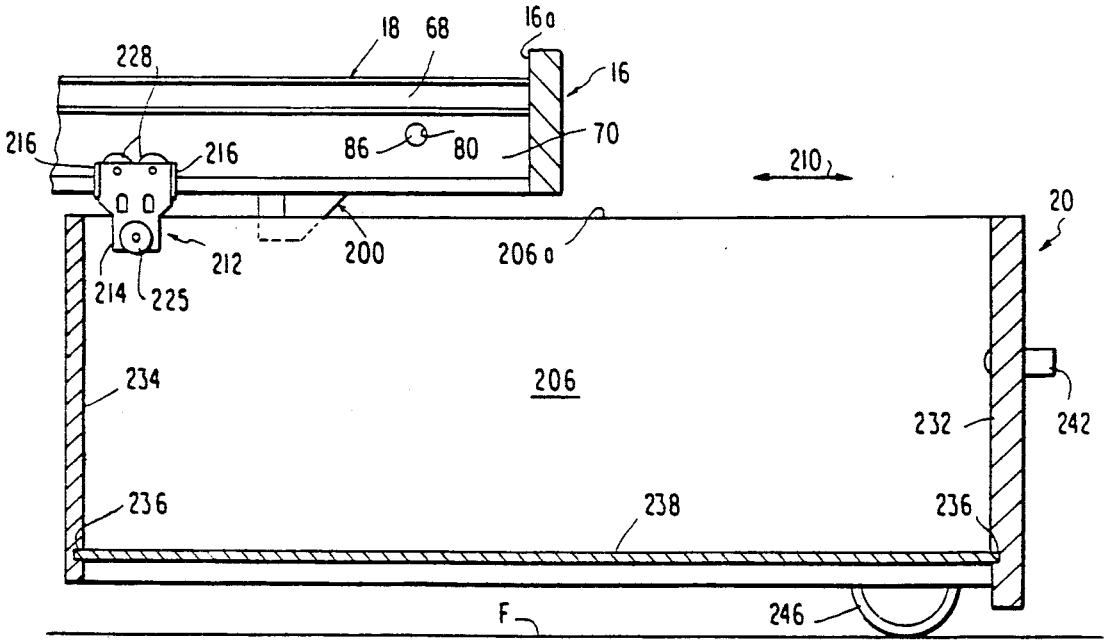
FIG. 5 is a vertical sectional view of a portion of the bed of FIG. 1 taken about line V—V, showing the coupling of the rear roller carrier to a channel and the latch wing of the overcenter coupling latch assembly functioning as a fixed guide and contacting the side of the drawer for guiding the drawer during insertion and removal from the bed frame.

The knockdown bed indicated generally at 10 consists principally of a headboard 12, a footboard 14 (both of which may be termed "endboards"), and a pair of opposed, laterally spaced mattress side rails 16. The side rails are equatable to the side boards of bed in the '689 Patent. Similarly, the components 12, 14 and 16 are detachably coupled or connected together in knockdown fashion via a plurality of generally U-shaped channel members 18 which are detachably coupled at their opposite ends to the opposed side rails 16. Unlike the bed in the '689 Patent, the side boards do not constitute ladder frames. In near identical fashion to the '689 Patent, knockdown coupling of components 12, 14 and 16 is effected using a number of overcenter couplings, each consisting of an overcenter latch assembly 34 which is physically mounted at respective ends of each of the U-shaped channel members 18 and which engage receiver assemblies 36 which are fixed to the mattress side rails 16, in this case in a single row along the inside face **16*a* of the mattress side rails 16 at longitudinally spaced positions. The overcenter couplings are identical to that of the prior '689 Patent with the exception of a modification to the latch assembly saddle member 84 as illustrated in FIGS. 4 and 5. In the exploded view of FIG. 1, the channel members 18 are shown in position supporting the edges of the thin mattress support panels 42. Further, as may be seen to the right, FIG. 1, the latch assemblies 34 have elements projecting therefrom at the ends of the channels for affixing to the receivers 36 on the inside face 16*a* of respective mattress side rails 16. In the illustrated embodiment, FIGS. 1–5, one channel member 18 is mounted along its side to the facing surfaces 12*a*, 14*a* of the headboard 12 and footboard 14, respectively for that embodiment. The channel members 18 extend horizontally and parallel to each other, the channel members 18 affixed to the footboard and headboard 12, 14 as well as the channel members longitudinally intermediate of members 12 and 14 are coupled at their ends via latch assemblies 34 to the mattress side rails 16. Further, the U-shaped channel members 18 are inverted such that the opening within each U-shaped channel member faces downwardly. Unlike the channel members 18 of the '689 Patent, they do not define four corner slides for slidably receiving the corners of the rectangular drawers 20**.

Figure 1:
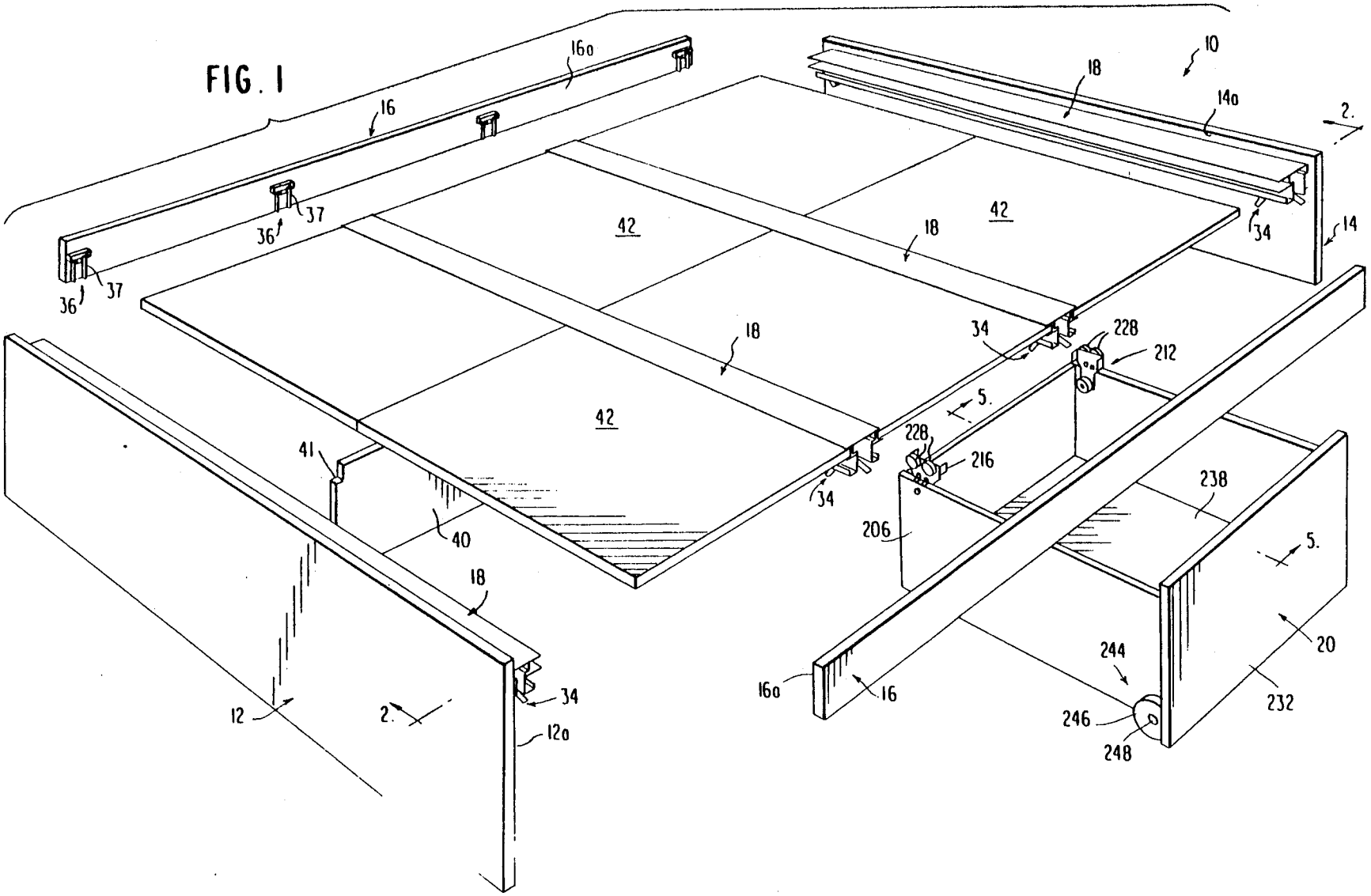
FIG. 1 is an exploded perspective view of the basic components of a 6-drawer platform type knockdown storage bed, forming a preferred embodiment of the invention.
Figure 6:
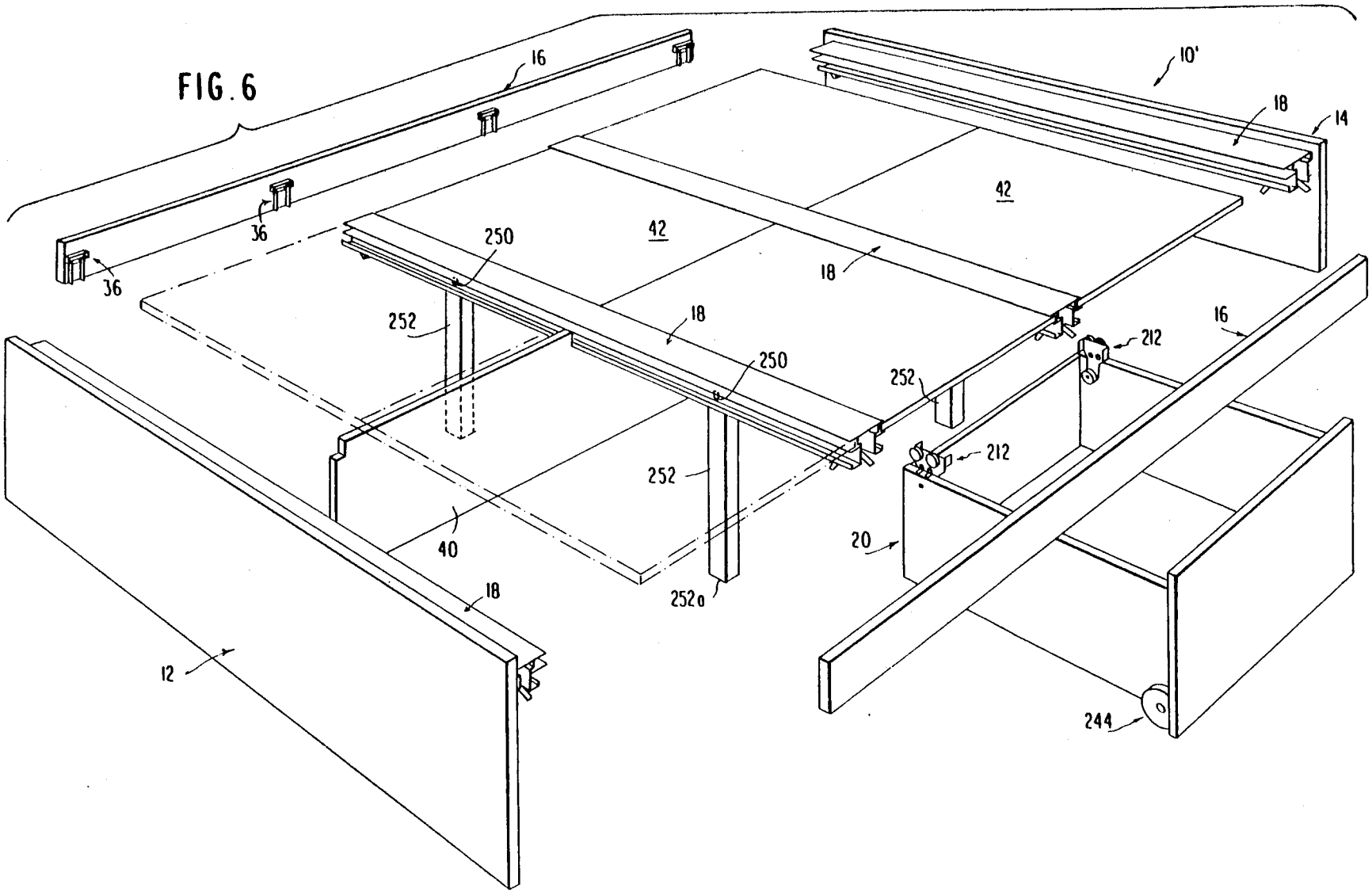
FIG. 6 is a perspective view of a further embodiment of the platform type knockdown storage bed of the present invention.

However, similar to the '689 Patent, there is provided in the embodiment of FIGS. 1–5 a center support panel or vertical spine panel 40 connected by pieces 41 to the head board and foot board respectively, upon which the channel members 18 rest. In the illustrated embodiment of FIGS. 1–5, six completely removable drawers 20 are mounted to the bed, three from each side, although only one is illustrated in FIG. 1. Further, similar to the '689 Patent, the receiver assemblies 36 each include a plastic or metal catch plate mount or channel member guide 37. In the '689 Patent the catch plate mount and channel guide member 37 is upside down from that shown in FIG. 1 of this application. Further, in the '689 Patent the channel members 18 mounted thereto, and as shown in FIGS. 4, 5 and 6 is right side up, rather than inverted as shown in FIGS. 1 and 5 of the application. FIG. 4 of this application shows the pivotable latch in a somewhat similar position to that shown in FIG. 6 of the '689 Patent. However, as may be appreciated from FIG. 5 of this application, in actual use the latch is upended from the position shown in FIG. 4, and with the overcenter coupling actuated and coupling the end of the channel 18 to the face 16*a* of side mattress rail 16, FIG. 5, vertically directed latch wings 200 projects vertically downward from the interior of the channel member 18 adjacent laterally opposed side walls 68 and specifically each laterally inward offset portion 70. The latch wings 200 have flat, relatively thin, vertical extension portions 200*a* rising from transversely extending, right angle finger 88 which joins the laterally opposed side walls 96 and in oblique side portions 200*b* which bend inwardly of portions 200*a* towards each other defining lead angle guide wings. Because the drawer in this type of bed may go all the way across, if it is slightly out of tolerance, it may kick open the latch on the far side of the bed by striking the back edge of the guide wing. The lead angle in the guide wing will allow the drawer to glide by even if it is slightly out of alignment. In all other respects the saddle member 84 is as it appears in the '689 Patent. The flat base portion 94 has opposite sides legs 92 which are in turn integrated to the right angle finger 88 via the laterally opposed side walls 96. The outwardly projecting circular bosses 86 have a diameter slightly less than the diameter of holes which receive the bosses within the channel member side wall offset portions 70, in accordance with the '689 Patent. The metal wire latch bar (not shown) has opposite ends thereof received within a slot such as slot 104 to complete the latch assembly 34, and which operates in accordance with the detail showing within FIGS. 3–6, inclusive of the '689 Patent.

Figure 2:
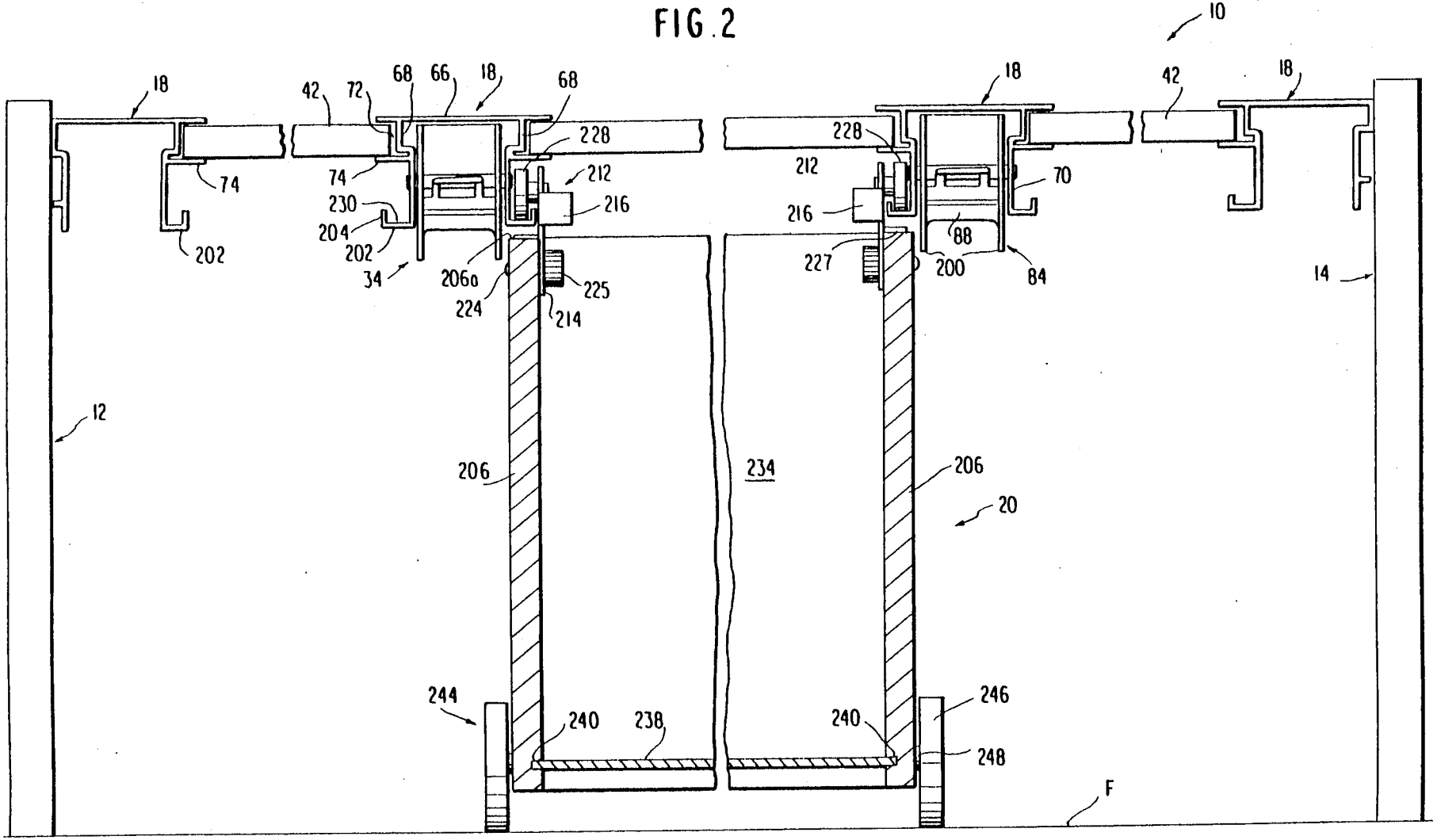
FIG. 2 is a vertical sectional view of the bed of FIG. 1 taken about line II—II of FIG. 1.
Figure 3:
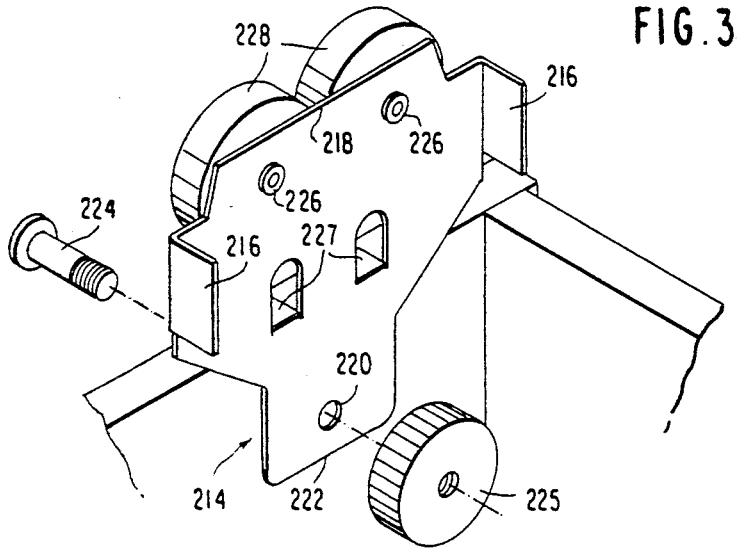
FIG. 3 is a perspective view of a drawer rear roller carrier, forming a portion of the roller support means for the drawers of the bed of FIGS. 1 and 2.

Referring to FIG. 2, the cross-sectional configuration of the channel members 18 are illustrated in detail, and show the difference between the channel member configuration and that of the '689 Patent. The channel members 18 formed of an extrusion of aluminum or other metal, similar to the '689 Patent, includes a base 66 from which extend vertical walls 68 having laterally offset right angle (vertical) portions 70. Portions 70 terminate in integral, L-shaped rails 202 which have reversely bent vertical ends 204 which project in the direction of base 66. The side walls 68 also include integral outwardly directed horizontal flanges 74 which form grooves 72 for receiving the edges of the mattress panels 40. The grooves 72 face away from each other, and to opposite longitudinal ends of the assembly. Unlike the '689 Patent, the flanges do not cooperate or act jointly with the laterally offset vertical side walls 70 to define drawer slides. Rather, the drawer 20 as seen in that Figure has laterally opposed side walls or drawer sides 206 whose upper edges 206*a* are some distance below rails 202 integral with the channel member 18. Absent some means for guiding the upper ends of the drawer sides 206, the drawers would be difficult to maintain in proper orientation during insertion and removal, as per FIG. 1. From FIG. 2 it is apparent that latch 84 is provided with the guide wings 200 to opposite sides of the right angle finger 88, and which when the latch is rotated to the position shown in FIGS. 2 and 5, the guide wings 88 extend below the upper edge 206*a* of the drawer side walls 206 so as to guide the drawers during movement into and out of a position beneath the bed mattress support assembly created by the channel members 18 and the panels 40. Additionally, the present invention advantageously provides means for suspending the rear of the drawers 20 using rails 202.

Suspension of the rear of each drawer 20 is achieved by laterally opposed drawer rear roller carriage assemblies 212. The assemblies may be viewed in FIGS. 2, 3. 4 and 5. Each drawer rear roller carriage takes the form of a near rectangular plan configured drawer rear roller carriage plate, indicated generally at 214, having a pair of integral, right angle bent ears or stops 216 near the upper edge 218 of that plate. Stops 216 abut the side mattress rail 16 or similar frame members to limit travel of the drawers. The plate 214 is provided with one bolt hole 220 upwardly from the bottom edge 222 which receives bolt 224 after passing through a corresponding hole 223 in drawer side wall 206. A threaded knob 225 is screwed to the end of bolt 224. FIGS. 2 and 5, for fixing the plate to the inside surface 206*a* of the drawer side wall 206. Struck out U-shaped tabs 227 at 90° to the vertical plane of plate 214 to respective sides of bolt 224 abut the upper edge 206*a* of drawer side wall 206 to prevent rocking of plate 214 about axis of bolt 224. A pair of roller supporting axles 224 are received within holes formed within the plate 214 below the upper edge 218, which receive ends of roller mounting studs 226, which are peaned over, FIG. 3. These studs are cantilever mounted, and function as journals for disc-like rollers 228. The rollers are of a lateral thickness less than the width of the groove 230 within the guide tracks 202, within which the rollers 228 rest, FIG. 2. The drawer is completed by a drawer front wall 232, a rear wall 234 and bottom wall 238. Horizontal slots 236 are formed in the rear wall and front wall 232 which face each other, are of a width slightly in excess of drawer bottom wall 238 and similar slots 240 are formed within the inner surfaces 206*a* of the drawer side walls 206 having a groove width matching grooves 236. The bottom wall 238 is received within slots 236, 240 and may be adhesively fixed to respective lateral side walls 206 and front and rear walls 232, 234 of the drawer 20. A handle or pull 240 is provided at the front of the drawer for manual manipulation of the drawer, i.e., the pull 240 may be screwed to the exterior of the front wall 232 as shown, FIG. 5. The rear roller carriages 212 are mounted by bolts 224 and threaded knobs 225 to the side walls 206, just inside of the rear wall 234. As seen in FIG. 5, the stop 216, to the right side of the plate 214, impacts against the inside side surface 16*a* of the side mattress rail 16 to prevent further opening of the drawer. This provides almost full access to the interior of the drawer, as per FIG. 6. Further, the plate 214 is attached to the side wall 206 of the drawer such that the bottom wall 238 of the drawer is maintained horizontal during its travel.

In the illustrated embodiment, in addition to the drawer being suspended at its rear by laterally opposite rear roller carriages 212, the drawer 20 is provided with a pair of side mounted casters 244 to opposite sides. The casters 244 constitute wheels or rollers 246 rotating about horizontal axles 248 which are fixedly mounted to respective side walls 206 of the drawer 20 in each instance.

Figure 17:
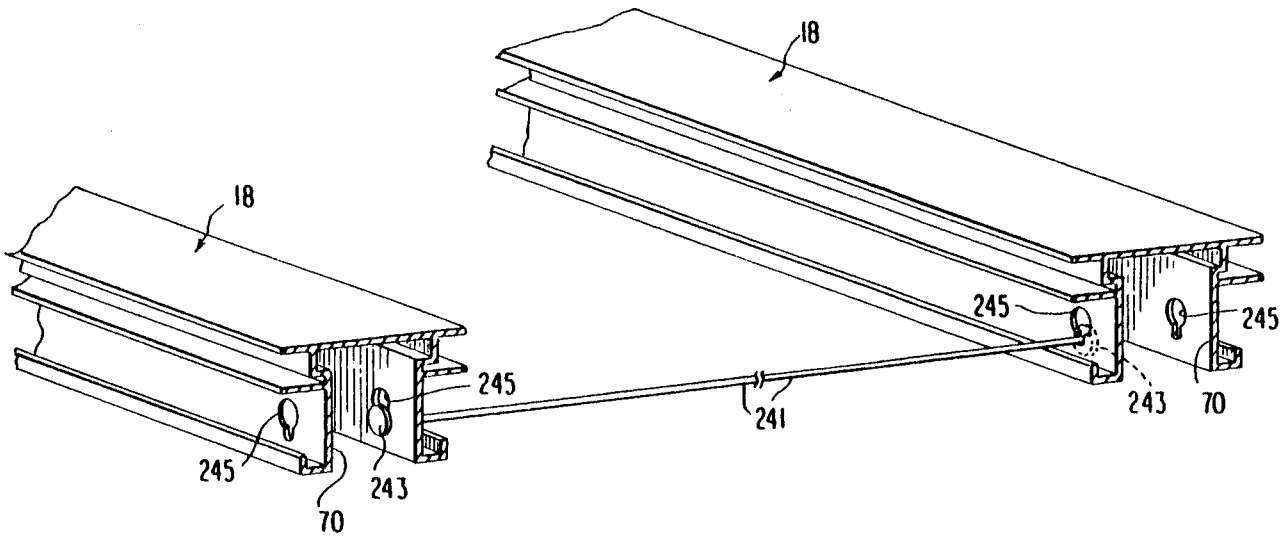
FIG. 17 is a perspective view of a wire stretcher coupling laterally opposed channel members to limit movement of a drawer in a drawer closure direction for the knockdown bed of FIG. 1.
Figure 16:
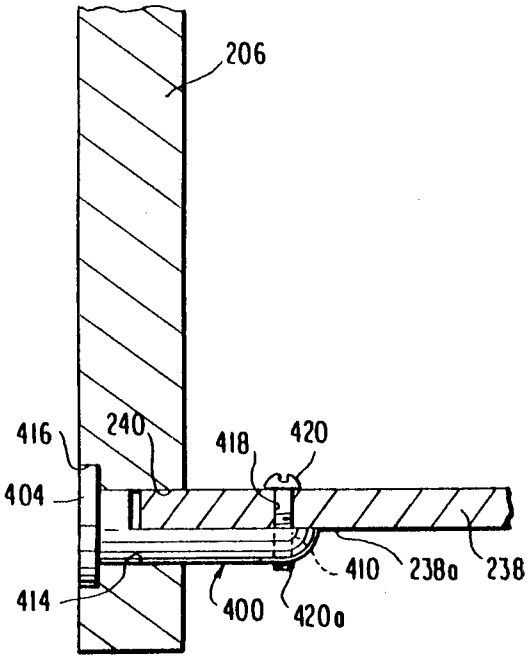
FIG. 16 is a sectional view of the drawer of FIG. 1 illustrating the plug drawer block physically coupling the drawer bottom along one side to a corresponding drawer side thereof.

Further, as seen in FIG. 2, the end channel members 18, abutting the head and foot boards on one side are devoid of flange 74 and the L-shaped guide tracks 202, to the left of channel member 18 which is screwed or otherwise mounted to headboard 12, and to the right for the channel member 18 oppositely oriented and fixedly mounted to the inside surface of footboard 14 of the bed 10. The platform storage bed 10 in the embodiment of FIGS. 1–5, inclusive, can be built for two, three or four drawers on each side of the bed, the six total drawer storage bed shown being exemplary of such construction. The diameter of the caster wheels 246 and the location of the axles 248 are such that the periphery of the wheels 246 rest on the floor F with the bottom wall 238 of the drawer 20 horizontal. The position of the drawer rear roller carriage plates 214 insure that horizontal orientation irrespective of whether the drawer is fully closed or fully opened. The other stop 216, FIG. 5, impacts against the center support panel 40 or center wire stops defined by a wire stretcher 241 having headed ends 243 removably inserted into keyhole shaped springs or holes 245 of respective channel 18 side walls at given longitudinal positions across the path of travel of a drawer slidably mounted thereto when a drawer 20 is fully inserted with its front wall 232 vertically oriented with the side mattress rail 16, FIG. 17.

As may be appreciated, the knockdown, platform-type storage bed 10 requires only the number of channel members 18 necessary to support, by the drawer rear roller carriages 212, the number of drawers for the bed, two, three, four, etc. on a given side. FIG. 2 illustrates the make up of the "dual" positioning mechanism which keeps the drawer 20 in alignment as it is being pulled from under the bed 10 and as it is being pushed back into place during closing. The rear of the drawer maintains its position because the rollers 228 of the rear roller carriage plate 214 roll in the tracks 202 formed on the underside of the channel members 18. The front of the drawer maintains its position because it is guided by a wing 200 that extends beyond the underside of the channel member 18 with a wing making contact with a given side of the drawer 20 on each side of the latch carried by the channel member and overlapping the upper edge **206*a* of the drawer side or side wall 206. As a result, the bed 10** (or one of modified forms) may be built with the same number of drawer options, i.e., two drawers, three drawers (twin sized beds), and four drawers and six drawers (double, queen and king sized beds).

Turning next to FIG. 6, there is shown a modified knockdown platform storage bed 10' which is identical to the bed 10 of FIGS. 1–5, inclusive, with the exception that the bed employs four fold-out legs, two for each of the intermediate channel members 18 which connect at opposite ends to the mattress side rails 16. Drawer 20 is identical to that of the FIG. 1 embodiment and its front and its rear roller suspension system via the drawer rear roller carriages 212 and the front casters 244 are identical to that first embodiment. Each of the channel members employs a horizontal pin or axle 250 for rotatably supporting rectangular hollow metal or wooden legs 252 which may be rotated from an upwardly horizontal position to the vertical upright position as shown in FIG. 6, and which are of a length sized such that the lower end **52*a* of each leg contacts the floor F, FIG. 2 when projected. As such, the fold-out legs provide extra support for a water mattress which, of course, adds substantial weight to the mattress deck as defined by the channel members 18 and the interposed panels 42, identical to that of the first embodiment. The center support panel 40 is shown in the position which it takes in the FIG. 1** embodiment, however, such center support panel may not be needed where the lateral racking loads (headboard to footboard) are taken up by the hardware that attaches the side mattress rails to the head board and footboard.

Figure 7:
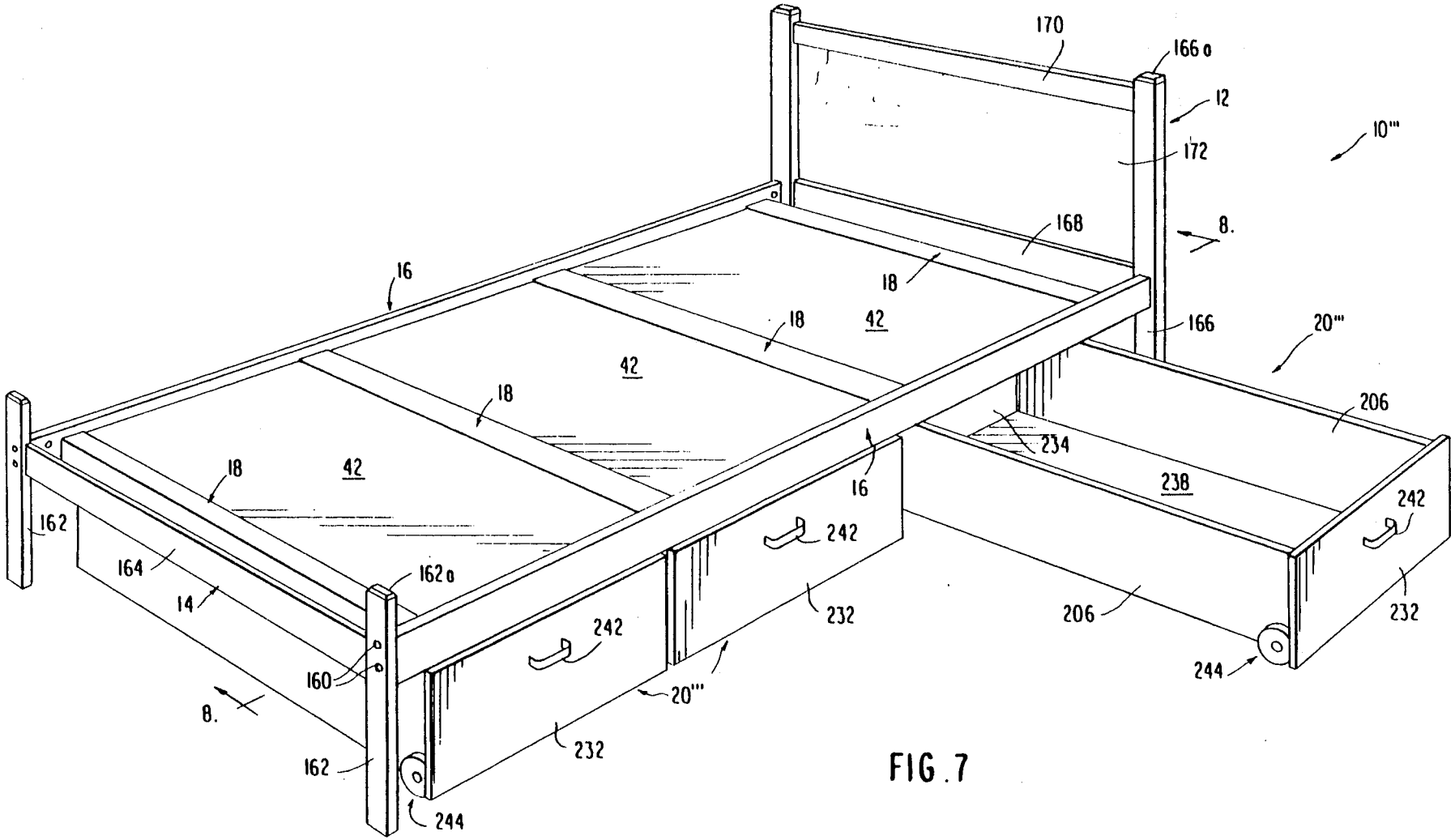
FIG. 7 is a perspective view of a traditional 4-legged platform bed forming a third embodiment of the present invention.
Figure 8:
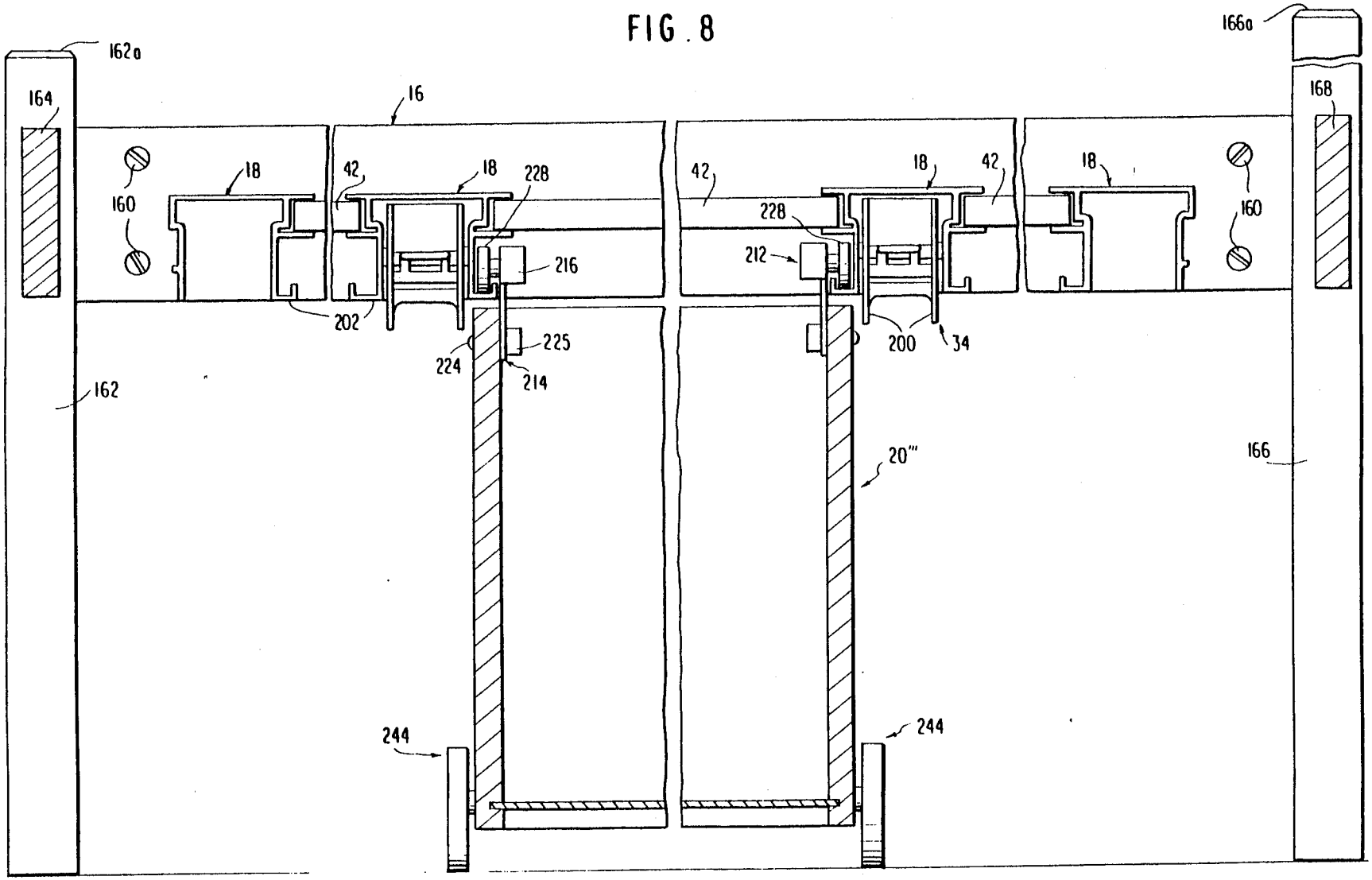
FIG. 8 is a vertical sectional view taken about line XII—XII of FIG. 6.
Figure 9:
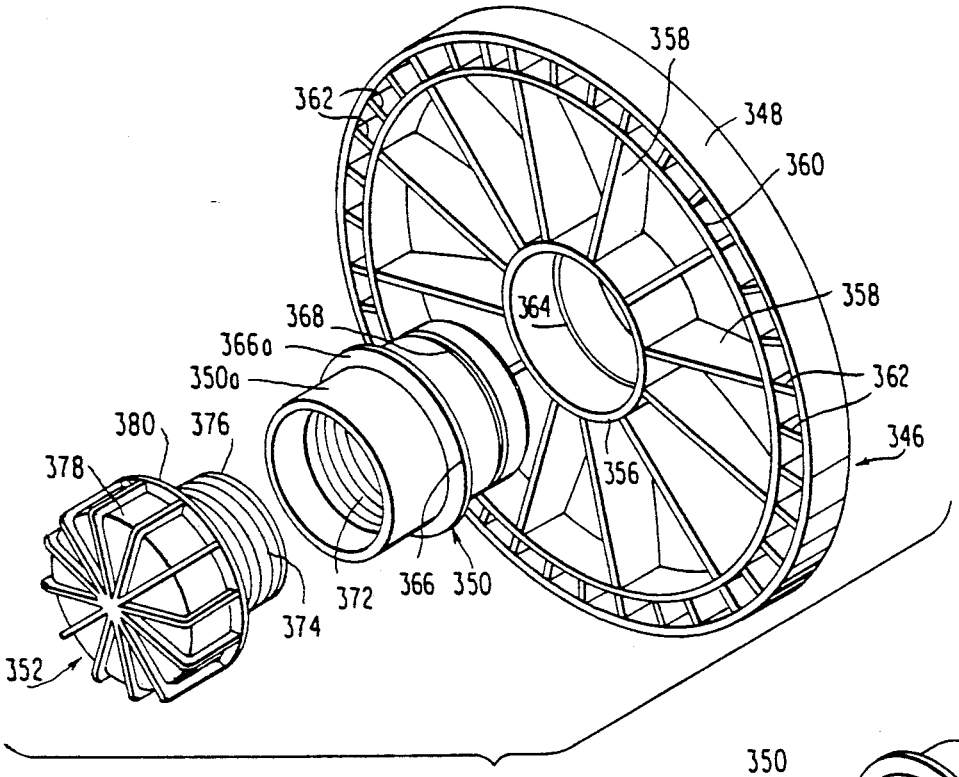
FIG. 9 is an exploded perspective view of a drawer front wheel assembly for a modified embodiment of the knockdown storage bed of the present invention.

Referring next to the embodiment of FIGS. 7 and 8, it is this type of center support bed indicated generally at 10''' where the center support panel 40 may be eliminated since the lateral racking loads (headboard to footboard) are taken up by the specific hardware that attaches to the side mattress rails 16 to headboard 12 and footboard 14.

In this bed, the side mattress rails 16 are attached to the head and footboards 12, 14, respectively by standard "off-the-shelf" hardware as for instance via elongated screws 160 which extend some length into the ends of the mattress side rails 16 from each of the vertical legs for both the headboard 12 and the footboard 14. In that respect, vertical legs 162 of relatively short vertical height are joined together by a transversely extending beam 164 which connects to the vertical legs 162 at some distance below the tops **162*a* of those legs. The horizontal beam 164 may be the same size or smaller than the side rails 16. Headboard 12 comprises the two other of the four legged platform bed legs, those legs 166 being considerably higher, and being joined by a lower beam 168 and an upper beam 170 which form with legs 166 an open frame receiving a thin headboard panel 172. The legs 166 terminate with their tops 166*a* at a considerable distance above the upper ends or tops 162*a* of the footboard legs 162. The knockdown storage bed 10''' includes four channel members 18 which are inverted so that their open ends face downwardly, and as per FIG. 8, attach in the same manner to the inner surface as the embodiment of FIG. 1, with the exception that the rails proximate to the headboard and footboard are not physically mounted to the opposite facing surfaces of the headboard beams 168 but are spaced some distance therefrom and coupled solely at their ends to the side rails 16. Further, in this case, the panels 42 extend the full lateral width of the bed between laterally opposed mattress side rails 16 and the drawers 20''' are of extended length so that when closed the rear walls 234 of the drawers are in line with one of the mattress side rails 16 while the drawer front walls 232 are aligned with the other side rail 16. The drawers are suspended in the same manner, and the drawer rear roller carriage plates include right angle projecting stops 216 which abut the inside surfaces of respective mattress side rails 16 during full opening and full closing, respectively, of drawers 20'''**.

For the three embodiments of the knockdown bed as described in detail above, and as shown in the accompanying drawings, in similar fashion to the beds of the '689 Patent, the couplings for connections permit the bed to be quickly assembled or knocked down within minutes or even seconds, and to a similar degree to that of the '689 Patent.

Figure 11:
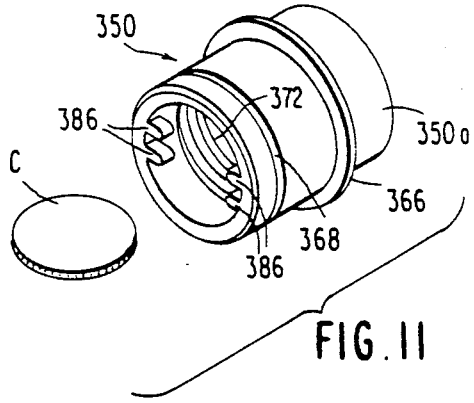
FIG. 11 is a perspective view of the axle forming an element of the drawer front wheel assembly of FIG. 9, as seen from the opposite end to that of FIG. 9.
Figure 10:
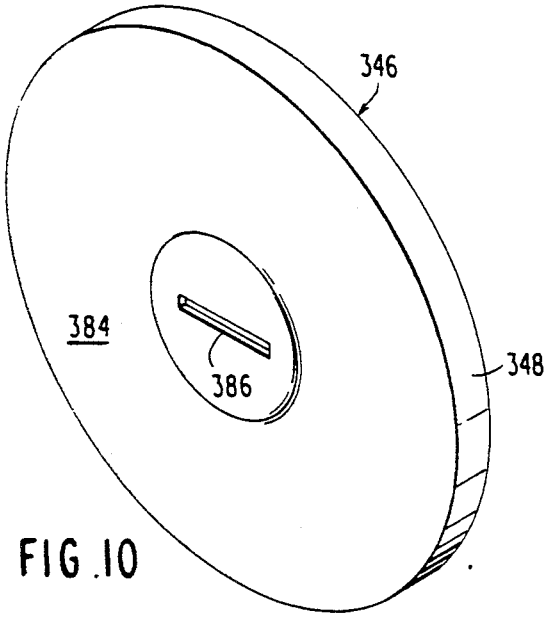
FIG. 10 is a perspective view of a molded plastic wheel forming one embodiment of the drawer front wheel assembly of FIG. 9.

FIGS. 9–12, inclusive, illustrate a drawer front wheel assembly 344 which is especially effective for supporting the front of the drawers 20 to each side thereof with rolling contact by the rim 348 of wheel 346 of that assembly. The two other components of assembly 344 are a hollow tubular axle 350 and a lock cap indicated generally at 352. All three pieces may be made of an injected molded plastic and are interfittingly connected. Assembly is effected by the requirement solely of a large diameter (1.25" approximately) hole drilled within the side wall 206 at 354. This is the extent of the machining required to install the wheel 346 to the drawer side 206. Preferably the wheel 346 and axle 350 are press fitted together at the factory before being shipped. Wheel 346 is provided with a cylindrical hub 356 from which radially emanates a series of circumferentially spaced spokes 358 integrated at the end radially outward of the hub 356, with rim 348. A false rim 360 of smaller diameter joins rim 348 via a series of circumferentially spaced, radially projecting cross bars 362. An annular, radially projecting lock ridge or rib 364 projects outwardly of the inner periphery of hub 356. The bore of hub 356 is slightly larger than the outer diameter of hollow axle 350. The hollow axle is provided axially intermediate of its ends with a radially projecting collar 366 which forms an axial shoulder **366*a* on the side of ridge 366 remote from wheel 346. The rib 364 may be in the form of an inclined ramp as per FIG. 12, with a groove 368 within the outer periphery of the hollow tubular axle 350 being of mirror image configuration and of a radial depth matching the radial height of lock ridge 364 such that a snap fit is effected between the molded plastic wheel 346 and axially inserted axle 350. The radial end face of hub 356 lies proximate to the side of the radial rib 366 opposite axial shoulder 366*a*. Once engagement is effected, the engaging right angle faces of groove 368 and lock ridge 364 prevent axle separation of these members. The components are held together permanently. The consumer who normally sets up the knockdown bed sees only two components, the lock cap 352 and the assembled axle 350 and wheel 346, Installation to the drawer side 206 is accomplished in the following manner. The hollow axle 350 whose outer diameter matches the diameter of hole 370 within the drawer side 206 is pushed into the hole 370 until the shoulder 366*a* abuts the outer surface of the drawer side 206, FIG. 12. The lock cap is then, from the inside of the drawer, threaded into the hollow threaded inner periphery of the axle 350. The internal threads 372 of axle 350 are threaded to the external threads 374 of shank 376 of the lock cap. The lock cap is completed by a radially enlarged flanged head 378. By screwing down lock cap 352, the lock cap pulls the axle seating shoulder 366*a* tight to the drawer side 206. The pull of the axle 350 to the drawer side is counterposed by the cap which exerts a reaction force via a radially enlarged lip 380 which exerts a force on the inside face 206*b* of the drawer As seen in FIGS. 10, 11 and 12, the axle 350 can be further tightened to the drawer side 206 by inserting a coin C in an elongated slot 382 in the exposed face 384 of the wheel. The coin C engages with laterally opposed tightening dogs 386 which are molded in the wheel and of the hollow axle 350. By holding the coin C in this manner, the axle/wheel assembly can be prevented from turning while exerting rotary tightening force on the lock cap 352. An additional feature of the drawer support system is that the wheel/axle/lock cap assembly 344 can accommodate itself to material of varying thickness, i.e., drawer sides in FIG. 12, a dimension labeled TD (telescope distance) as illustrated relative to the lock cap 352. A smooth, unthreaded portion of the axle 350*a* telescopes in or out of the lock cap annular groove 390 within the head 378 of that lock cap, radially interior of lip 388, depending on the relative thickness of the drawer side 206. The range of material thickness accepted by the product is 0.25" to 0.625" in the illustrated embodiment. It should be noted that the interior of the hollow axle 350 is slightly stepped to allow the free passage of the lock cap 352 threads 374 as they travel in or out of annular groove 390 within head 378 responding to drawer sides 206** of different thickness.

The present invention is also directed to a structure for the drawers 20 in which the drawer blocks indicated generally at 400, FIGS. 13–15, inclusive, complete the assembly of the drawers and maintain the drawers with a bottom wall rigidly connected to and between laterally opposed drawer sides. Preferably the drawers for the beds in the illustrated embodiment are shipped flat ready for the consumer to assemble as part of the bed assembly process. Drawer blocks are little blocks that are normally glued to the underside of a drawer to prevent the drawer sides from racking out of their 90° orientation to one another. Typically drawer blocks are glued to the drawer bottom and the sides. Once dry, the glue holds the sides to the bottom and the racking forces have to distort the drawer bottom to move the drawer sides. In the past, manufacturers shipped their drawers flat and used sophisticated hardware to attach drawer sides to one another. This requires the customer to install via glue wooden drawer blocks to the underside of the drawer. Assembly time is delayed as one must wait for the glue to dry before using the product after assembly. The plug drawer block indicated generally at 400 eliminates the necessity for gluing and the drawer may be used immediately after assembly. FIGS. 13, 14 and 15 illustrate respectively a top plan view of the plug drawer block 400, a side elevational view and a rear elevational view thereof. The block is formed of wood rod stock (or molded plastic) of cylindrical form. The cylindrical body 402 has a radially enlarged collar or flange 404 at one end forming a cylindrical disc plug. Further, a recess 406 is cut into the top of the body 402 to the plug center line 408. The end of the body 402 remote from the plug 404, is of spherical form, and a drilled hole 410 passes through the body 402 adjacent the spherical tip portion 412 at the plug center line 408. The recess 406 permits the drawer bottom wall 238 to be received thereby. A cylindrical hole 414 is drilled within the drawer side 206 and is counterbored at 416 so as to permit entry of plug 404. The center line of the hole 414 coincides with the underside of the drawer bottom **238*a*. The drawer block 400 is projected into hole 410 within body 402 of the drawer block 400 is hole 410 within body 402 of the drawer block 400 is aligned with a drilled hole 418 within the drawer bottom wall 238. A screw 420 is screwed through aligned holes 418, 410 within the drawer bottom wall 238 and the drawer block body 402 such that the threaded shank 420*a* of the screw binds the drawer bottom wall 238 and the drawer block 400** together. The structure is simple but very effective and eliminates the necessity for gluing, the delay in waiting the glue to dry prior to completion of the assembly and use of the drawer.

While the invention has been particularly shown and described with reference to preferred embodiments thereof, it will be understood by those skilled in the art that the foregoing changes in form and details and other changes may be made therein without departing from the spirit and scope of the invention as expressed by the following claims.

What is claimed is:

1. A knockdown bed comprising:

longitudinally spaced bed end boards, laterally opposed bed side boards, a plurality of extruded U-shaped channel members of a length approximately that of the length of said end boards, each of said U-shaped channel members fixedly mounting at opposite ends, a detachable coupling latch assembly, receiver assemblies, sized and configured to fit within the ends of the U-shaped channel members, fixedly mounted to the said opposed side boards at longitudinally spaced positions at a uniform height and forming at least one row of receiver assemblies on each side board with said receiver assemblies being in diametrically opposite alignment for respective side boards, said latch assemblies at said channel member ends each including means for direct self-coupling to diametrically opposite receiver assemblies on opposed side boards, respectively, said channel members including open slots on the sides thereof facing each other, thin rectangular panels slidably inserted within facing slots of said channel members such that said panels and said channel members form a planar box spring and mattress support across the top of the bed longitudinally from one bed end board to the other, and laterally from one bed side board to the other, and defining a relatively rigid bed frame, said U-shaped channel members including a base, a pair of laterally spaced side walls extending perpendicular from said base, said side walls terminating in laterally outwardly directed horizontal rows, away from each other.

rectangular, upwardly open drawers of a vertical height less than that of said planar box spring and mattress support having opposed vertical side walls, drawer rear roller carriages mounted to said drawer side walls at the rear of the drawers to opposite sides thereof, and including first rollers mounted for rotation about horizontal axes above said drawers, said first rollers positioned within rails for suspending said drawers at said rear, and second rollers mounted for rotation about coaxial horizontal axes to the bottom of said drawers adjacent a front wall thereof on opposite sides thereof, with said second rollers in peripheral contact with a floor, whereby said second rollers support the front of the drawers during movement beneath the planar box spring and mattress support with said rear roller carriages suspending the rear of the drawers such that the mass of the drawer and any contents thereof are substantially supported by the floor while said rollers in contact with said rails and with the floor respectively at the rear and front of the drawers substantially reduce friction during movement of said drawers from closed to opened position and vice versa.

2. The knockdown bed as claimed in claim 1, wherein each of said receiver assemblies comprises a U-shaped channel member guide sized and configured to fit into the interior of the channel member at its open end in surface contact therewith, and being mounted to the face of the side board proximate to the end of said channel member.

a vertical, plate-like catch mounted to the interior of the U-shaped guide member, and terminating at an upper end in a C-shaped hooked portion having an open side facing away from said channel member, and wherein each latch assembly comprises an inverted U-shaped saddle member, including a horizontal base, legs depending from the saddle member base at opposite sides thereof, said legs being mounted for rotation about an axis projecting at right angles through said saddle member leg.

an integral finger projecting at right angles to the base of the saddle member, a U-shaped wire latch bar pivotally mounted at its free ends to saddle member base and projecting outwardly therefrom, and being pivotal from a position in line with said base to one generally at right angles thereto, parallel to said finger, and wherein said U-shaped wire latch bar is of a length wherein holes within each said channel member rotatably mounting said saddle member are positioned such that the U-shaped wire latch bar is movable into engaging contact with the C-shaped hook portion of the plate-like catch, and by deflecting said finger from a vertical position to a generally horizontal, in line position, the U-shaped wire latch bar is pivoted overcenter across the saddle member pivot axis, causing the end of the channel member to abut the side board to capture the channel member guide internally of the U-shaped channel member to establish a rigid coupling via the overcenter action of said coupling latch bar between said channel member and the face of the bed side board, and wherein said saddle member legs extend beyond said right angle finger in laterally spaced parallel fashion at right angles to said finger and form guide wings which project beneath said rail so as to overlap top edges of said side walls of said drawers to guide said drawers during movement between open and closed position over the length of said rail with said rear roller carriage roller retained within said rails during such movement.

3. The knockdown bed as claimed in claim 1, wherein said second rollers casters comprise vertical axles fixedly mounted to respective drawer sides, projecting outwardly therefrom, proximate to the bottom wall of said drawers and said second rollers further comprise caster wheels mounted to the ends of said projecting axles for rotation about horizontal axes common to said axle and said wheel.

4. The knockdown bed as claimed in claim 1, wherein said drawer rear roller carriages each comprise a rectangular sheet metal plate.

at least one stub axle fixedly mounted to said plate and projecting from one side thereof, extending at right angles to the plane of said plate, a roller mounted for rotation about its axis on said at least one stub axle, and means for fixedly mounting said plate to the inside surface of the respective drawer sides such that said at least one roller overlies the upper edge of said drawer side and is spaced therefrom such that said at least one roller of said drawer rear roller carriage is fitted into and suspended by said rail at the rear of the drawer.

5. The knockdown bed as claimed in claim 4, wherein said drawer rear roller carriage plate includes right angle stops integral therewith to opposite sides thereof at positions adjacent said rollers for contact respectively with a side mattress rail during opening of the drawer to limit opening, and for abutment with a vertical member of the knockdown bed for limiting movement of said drawer beneath said planer box spring and mattress support to a closed drawer position with the front wall of the drawer in vertical alignment with the mattress side rail.

6. The knockdown bed as claimed in claim 2, further comprising a plurality of fold-out legs pivotally mounted at one end to said channel member for swinging movement up and into the downwardly facing opening within the center of the U-shaped channel members at positions remote from opposite ends and being of a length such that the ends opposite the pivot connections to the channel members contact the floor when folded out to positions at right angles to the plane of the channel member base to increase the load support capability of the thin, rectangular panels and the channel members forming said planar box spring and mattress support across the top of the bed, and wherein said channel member rails suspend the rear of the drawers via said rear roller carriages, irrespective of whether the fold-out leg is projected at right angles to the channel base or folded to and in line parallel position with said channel base within the internal channel thereof.

7. The knockdown bed as claimed in claim 2, wherein said guide wings include upright portions which extend obliquely towards each other to engage the edges of the side walls of the drawers thereby centering the drawers during drawer movement between open and closed positions.

8. The knockdown bed as claimed in claim 4, wherein said means for fixedly mounting said plate to the inside surface of the respective drawer side comprises a single hole within said plate, an aligned hole within a respective drawer side.

a headed bolt projecting through the drawer side hole and the aligned hole of said plate.

a knob threaded to a threaded shank end of said bolt on the side of said plate remote from said drawer side, and wherein said plate includes a pair of struck out U-shaped tabs of the plate, at right angles to the plane of the plate to respective opposite sides of said hole bearing said bolt and engaging the upper edge of the drawer side so as to prevent rocking of said drawer rectangular sheet metal plate about the axis of said bolt and to maintain orientation of said roller mounted for rotation about its axis on said at least one sub-axle in engagement with said rail.

9. The knockdown bed as claimed in claim 1, wherein said second rollers comprise drawer front wheel assemblies mounted to laterally opposed drawer sides adjacent to the front wall of said drawer, each drawer front wheel assembly comprises a hollow tubular axle partially projecting within a hole within a drawer side, said axle having a first tubular portion projecting axially beyond the drawer side to the outside of the drawer, a wheel mounted for rotation on said axially projecting portion of said hollow axle, and a locking cap fixed to said hollow axle and sandwiching said drawer side between said locking cap and said hollow axle to frictionally lock said hollow axle to said drawer side.

10. The knockdown bed as claimed in claim 9, wherein said hollow axle includes a radial collar on the outer periphery thereof intermediate of the axial ends of said hollow tubular axle, said lock cap includes a radially projecting lip, wherein said radial collar on said hollow tubular axle defines an axial stop engaging one face of said drawer side, and wherein said lip of said locking cap engages the opposite face of said drawer side to frictionally lock said hollow tubular axle to said drawer side.

11. The knockdown bed as claimed in claim 9, wherein said hollow tubular axle includes a lock groove within the inner periphery thereof, and wherein said wheel comprises an axial bore sized to the axial projection of said axially projecting portion of said hollow tubular axle and including an inwardly radially projecting wheel lock ridge configured to and sized to said axial lock groove within the outer periphery of said axial projecting portion of said hollow tubular axle, and being snap fitted thereto such that said wheel rotates on said hub about said hollow tubular axle but is prevented from shifting axially due to the engagement between the axial lock groove and the wheel lock ridge.

12. The knockdown bed as claimed in claim 11, wherein said locking cap includes a threaded outer peripheral threaded portion, and wherein said hollow tubular axle includes an inner peripheral threaded portion threadably engaged therewith for maintaining said axle radial seating shoulder engaged with one face of said drawer side and said locking cap lip engaged with the opposite face of said drawer side.

13. The knockdown bed as claimed in claim 5, wherein said vertical member of the knockdown bed for limiting movement of the drawer beneath said planar box spring mattress support to a closed drawer position comprises a wire stretcher consisting of a wire rod having radially enlarged headed ends, and wherein said extruded U-shaped channel member to opposite sides of each said rectangular, upwardly open drawer includes keyhole shaped holes having intersecting large diameter and small diameter positions within opposed vertical side walls thereof receiving the headed ends of said wire rod of diameters smaller than the large diameter portions of said keyhole shaped hole with said wire rod being of a diameter slightly smaller than a small diameter portion of the key hole, which portion of the key hole is in excess of the diameter of the headed ends of said wire stretchers, and wherein the length of the wire stretcher is such that the headed ends engage the rear surfaces of the channel side walls at said key holes to lock the wire stretcher in position spanning across and between said laterally spaced channel member to lie in the path of movement of the drawer at said closed drawer position with the front wall of the drawer in vertical alignment with the mattress side rail.

14. A knockdown bed as claimed in claim 1, wherein said rectangular, upwardly open drawers are further defined by a horizontal bottom wall extending transversely between said opposed vertical side walls, said drawer side walls including longitudinally extending horizontal grooves within the drawer side wall faces, facing each other receiving opposite edges of said bottom wall, and wherein at least one plug drawer block cylindrical hole is drilled within each drawer side wall with the center of the hole aligned with the underside of the drawer bottom wall, wherein a counterbore is formed on the drawer side wall outer surface, and wherein a plug drawer block of cylindrical form having a cylindrical body sized to the bore within the hole within the drawer side wall is fitted therein, wherein said plug drawer block includes a radially enlarged plug fitted within the counterbore, said body includes a recess within the upper face thereof to the center line of the plug, of a thickness on the order of the drawer bottom wall, and wherein said drawer bottom is of a width such that the drawer bottom fits between the body of the plug drawer block at said recess, and into the elongated horizontal groove within said drawer side, and wherein said drawer bottom at said drawer body includes a hole at right angles to the center line through said recessed portion and alignable with the hole within the drawer bottom, and wherein a screw has a shank portion extending through the aligned holes of the drawer bottom and said drawer block body, whereby the drawer side and drawer bottom are rigidly coupled to each other without the necessity of gluing of the plug drawer block to the drawer side and to the drawer bottom, with the screw binding the plug drawer block to the drawer bottom.

* * * * *